US007896345B2

(12) United States Patent
Cacas

(10) Patent No.: US 7,896,345 B2
(45) Date of Patent: Mar. 1, 2011

(54) BONUS WIN SYSTEM FOR SKILL GAMES

(76) Inventor: Clay Thomas Cacas, Terrell, TX (US)

( * ) Notice: Subject to any disclaimer, the term of this patent is extended or adjusted under 35 U.S.C. 154(b) by 85 days.

(21) Appl. No.: 12/316,524

(22) Filed: Dec. 12, 2008

(65) Prior Publication Data

US 2010/0148435 A1 Jun. 17, 2010

(51) Int. Cl.
*A63F 7/28* (2006.01)
*A63F 7/02* (2006.01)

(52) U.S. Cl. ..... 273/138.1; 273/138.2; 273/138.3; 273/440; 273/454; 273/460; 463/7; 463/16

(58) Field of Classification Search ..... 273/138.1, 273/138.2, 138.3, 138.4, 440, 454, 460; 463/7, 463/16

See application file for complete search history.

(56) References Cited

U.S. PATENT DOCUMENTS 4,496,160 A 1/1985 Wichinsky et al.
5,275,402 A * 1/1994 Malavazos et al. ..... 273/138.2
5,501,466 A 3/1996 Welch et al.
5,622,366 A * 4/1997 Inoue ..... 273/138.2

* cited by examiner

*Primary Examiner* — Benjamin H Layno
(74) *Attorney, Agent, or Firm* — Keith E. Taber; Klemchuk Kubasta LLP

(57) ABSTRACT

A game apparatus is provided comprising a cabinet defining a playing area including a plurality of shelves mounted therein where each of the shelves has disposed thereon a plurality of game pieces. A receiving mechanism is attached to the cabinet for accepting a playing piece. A playing area with one or more holes that allow game pieces to fall through the playing area into a mechanism that collects the game pieces until the weight of the pieces is greater than the counter weight and allowing the rocker arm to rotate and dispense the game pieces into the receiving mechanism or reward the player a prize by another method.

1 Claim, 2 Drawing Sheets

Side view of despensing Mechanism

Fig. 1
front view
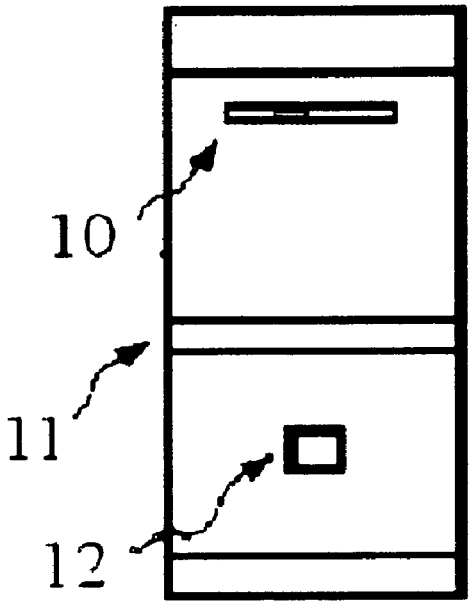
Fig.2
side view
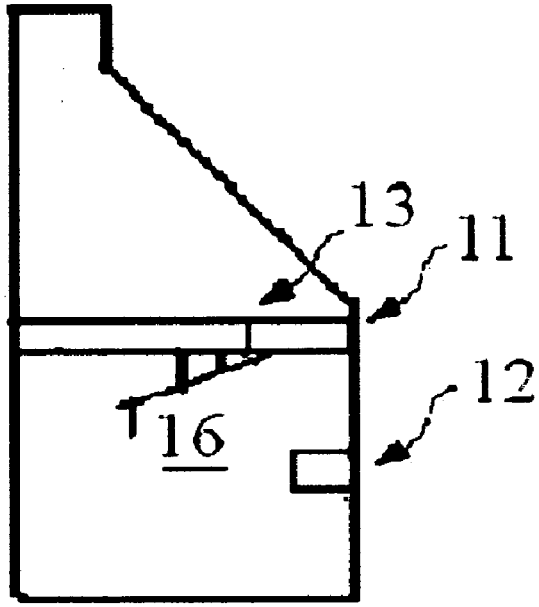
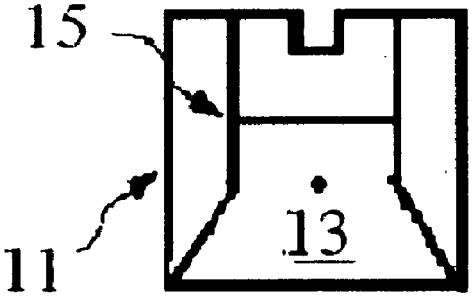
Top view of playing area
Fig.3
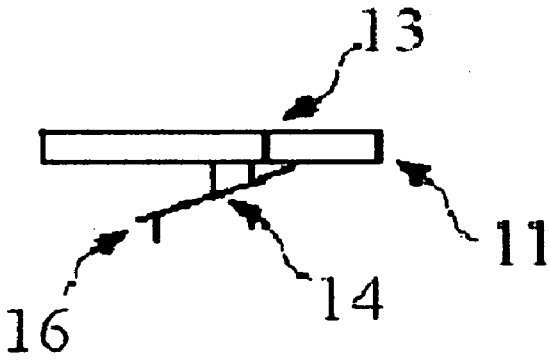
Side view of playing area
Fig.4
Present invention with preferred embodiment Side view of despensing Mechanism

BONUS WIN SYSTEM FOR SKILL GAMES

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING

Not Applicable

BACKGROUND OF INVENTION

This invention relates generally to amusement games and more particularly, relates to skill games refer to as Quarter pushers.

Amusement games in which coins are dropped onto a shelf traversed by By pusher bars is well known. In such an arrangement the coins buildup on a shelf until the constant movement of the pusher bar causes coins to fall off a forward edge of the shelf as a reward. A further known device is a game apparatus comprising a cabinet defining a playing area, means for receiving a playing piece such as a token or the like, means for projecting playing piece within the playing area, and a sensor disposed within the playing area, which may be triggered by a projected playing piece. The sensor when actuated by contact causes the apparatus to register a predetermined reward. The device further includes a lower shelf surface onto which the playing pieces may fall after projection which includes a pusher for pushing the collected playing pieces from the shelf. The latter device may be seen in U.S. Pat. No. 4,496,160 to Wichinsky et al.

While these devices work for their intended purpose, there exists a need for a novel amusement apparatus having new features whereby renewed interest by players of redemption type games will be generated.

An object of the present invention is to provide an improved game apparatus including a bonus that requires skill and chance and which, in the preferred embodiment, is combined with such known amusement apparatus.

It is another object of the present invention to provide a novel apparatus that will generate new interest in these amusement games in both games played with coins and with games played with tokens.

An object of the present invention is to provide an improved game apparatus in which one or more holes in the playfield will be used with a mechanism to collect and dispense the game pieces or other prizes to the player.

BRIEF SUMMARY OF THE INVENTION

In accordance with these objects, a game apparatus is provided comprising a cabinet defining a playing area including a plurality of shelves mounted therein where each of the shelves has disposed thereon a plurality of game pieces. A receiving mechanism is attached to the cabinet for accepting a playing piece. A playing area with one or more holes that allow game pieces to fall through the playing area into a mechanism that collects the game pieces until the weight of the pieces is greater than the counter weight and allowing the rocker arm to rotate and dispense the game pieces into the receiving mechanism or reward the player a prize by another method.

A better under standing of the objects, advantages, feature, properties and relationships of the invention will be obtained from the following detailed description and accompanying drawings which set forth an illustrative embodiment and is indicative of the various ways in which the principles of the invention may be employed.

BRIEF DESCRIPTION OF THE DRAWINGS

FIG. 1 front view of present invention shown with preferred embodiment;

FIG. 2 side view of present invention shown with preferred embodiment;

FIG. 3 top view of playing area

FIG. 4 side view of playing area

DETAILED DESCRIPTION

Figure 5:
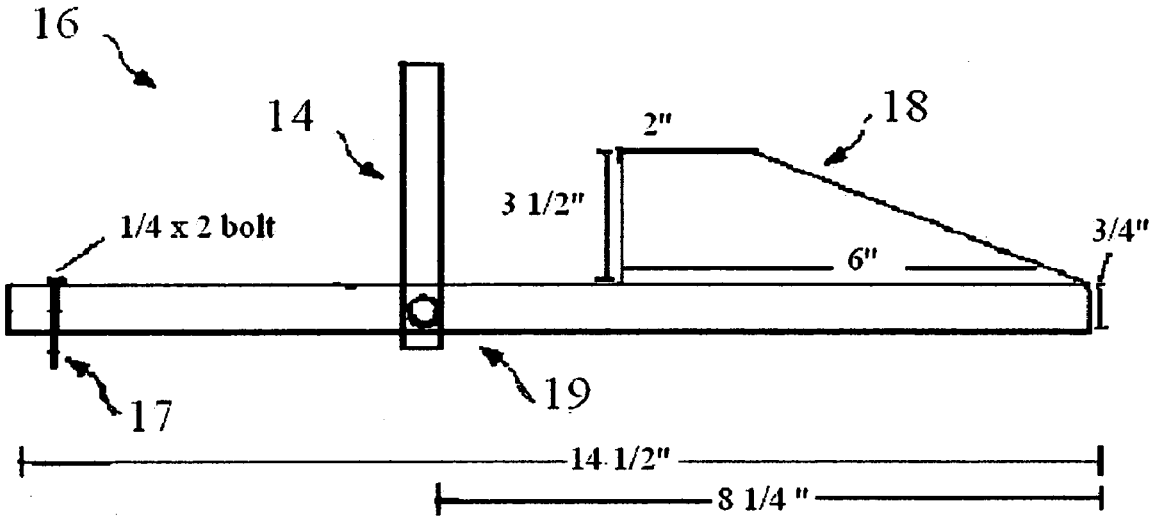
FIG. 5 detailed view of prize dispensing system for game pieces

While the inventions contained herein can be used in all types of amusement games it will be described hereinafter in the context of a bonus win system as the preferred embodiment thereof.

Referring now to the drawings, wherein like reference numerals refer to like elements, the front of the game apparatus is shown generally in FIG. 1. Generally comprises a cabinet containing a coin accepting and projecting mechanism 10 a playing area 11 where said playing area is comprised of two shelves 11 and FIG. 3, 15 where 15 transverses the playing area and where 11 has a 1" hole 13 that allows some playing pieces to fall thru the playing area into a dispensing mechanism FIG. 2, 16, and a playing piece redemption mechanism 12.

The playing piece acceptor 10 allows the player to control the position of the acceptor by sliding it in a right or left direction. The player inserts the playing pieces in the acceptor and then accelerated by gravity these pieces are projected on the playing area 15 The player uses skill to control the path of the pieces to influence the affect it will have on the other pieces.

The dispensing mechanism FIG. 5,16 is mounted under the playing surface of the playing area 11. Two 4" L brackets FIG. 5, 14 are attached 1" apart. The playing piece collector FIG. 5, 18 is positioned so that it collects pieces that fall thru the bonus hole 13. A 2" bolt is used to attach the dispensing mechanism 16 to the brackets 14 using the mounting hole 19.

The dispensing mechanism 16 has a 2" bolt FIG. 5, 17 attached at the opposite end from the playing piece collectors 8 this bolt is used as a counter weight and is adjusted by adding or removing washers until the desired amount of playing pieces required to weigh more than the counter balance is achieved.

The dispensing mechanism FIG. 5, 16 will rotate clockwise when enough playing pieces are collected in the playing piece collectors 8. When the counter balance bolt contacts the bottom of the playing area 11 the playing pieces are projected out of the collectors 8 into the redemption mechanism 12 after which the dispensing mechanism 16 rotates counter clockwise to the home position.

By replacing dispensing mechanism 16 with a electrical mechanism that can be interfaced with a control board which could operate any type of electrical dispensing mechanism that would reward players with different types of prizes.

The Playing area 11 could contain a plurality of bonus holes 13 generating even more interest in skill games.

It should be apparent from the preceding description that this invention has among other advantages, the advantage of providing a unique skill game capable of variable play through operator adjustments.

While specific embodiments of the invention have been described in detail, it will be known by those skilled in the art that various modifications and alternatives to those details could be developed in the light of the overall teachings of the disclosure. Accordingly, the particular arrangements disclosed are meant to be illustrative only and not limiting as to the scope of the invention which is to be given the full breadth of the appended claims and any equivalent thereof.

What is claimed is:

1. A game apparatus comprising a cabinet defining a playing area, a receiver for receiving and accepting or rejecting a playing piece such as a coin or token, a projector for projecting an accepted playing piece within the playing area, at least one shelf disposed in a lower portion of the playing area and onto which projected playing pieces may fall after projection within said playing area, at least one bonus hole in the shelf that allows playing pieces to fall through the playing area into a prize dispensing mechanism, said shelf being traversed by a pusher which pushes playing pieces collected thereon towards an edge of the shelf, and a container attached to a rod which is attached below the playing area and has a bolt attached to the opposite end of the rod for the purpose of adding weight and adjusting the amount of playing pieces required to cause the container to rotate and dispense the playing pieces in the prize dispensing mechanism.

* * * * *